US007832469B2

(12) United States Patent
Maiolo et al.

(10) Patent No.: US 7,832,469 B2
(45) Date of Patent: Nov. 16, 2010

(54) DEVICE FOR REMOTELY ACTUATING THE SAFETY LOCK OF INDIVIDUAL OIL PUMPING APPARATUS

(76) Inventors: Marcos Damian Maiolo, Arevalo 589, Lobos, Buenos Aires (AR); Miguel Angel Siddi, Gutierrez de la Concha 412, Rada Tilly, Comodoro Rivadavia, Chubut (AR); Alexandro Daniel Matteo, Capitan Canepa 330, Rada Tilly, Comodoro Rivadavia, Chubut (AR)

( * ) Notice: Subject to any disclaimer, the term of this patent is extended or adjusted under 35 U.S.C. 154(b) by 1133 days.

(21) Appl. No.: 11/380,687

(22) Filed: Apr. 28, 2006

(65) Prior Publication Data

US 2009/0159263 A1 Jun. 25, 2009

(51) Int. Cl.
*E21B 43/00* (2006.01)

(52) U.S. Cl. ..... 166/75.11; 74/41; 292/216

(58) Field of Classification Search ..... 166/68, 166/75.11; 74/22 A, 577 S, 41; 292/201, 292/216

See application file for complete search history.

(56) References Cited

U.S. PATENT DOCUMENTS 2,443,744 A * 6/1948 Mohnkern ..... 188/69
4,275,609 A * 6/1981 DeLaney ..... 74/41
4,453,426 A * 6/1984 Groutage et al. ..... 74/2

* cited by examiner

*Primary Examiner*—David J Bagnell
*Assistant Examiner*—David Andrews
(74) *Attorney, Agent, or Firm*—Michael Diaz

(57) ABSTRACT

A device for remotely actuating the safety lock of individual oil pumping apparatuses, (also known as AIB) employed in oil wells for extraction of this fluid. The actuating device or locking device permits an AIB operator to remotely actuate a safety lock for locking the entire movement of the AIB, without the need for the operator to go into an area of the AIB where the safety lock is usually housed. For this purpose the locking device includes an actuator for moving upwardly and downwardly the safety lock. The locking device also includes an indicator for indicating the position of the safety lock.

3 Claims, 4 Drawing Sheets

DEVICE FOR REMOTELY ACTUATING THE SAFETY LOCK OF INDIVIDUAL OIL PUMPING APPARATUS

FIELD OF THE INVENTION

The present invention relates to a device for remotely actuating the safety lock of individual oil pumping apparatuses. These individual oil pumping apparatuses are generally called AIB, also known as storks and little horses.

The rectilinear pumping movement of the AIB is generated by a motor, such as an electric motor, explosion engine or the like actuating over a mechanism for transforming movement. When it is necessary to stop the operation of these pumping apparatuses, either for operative questions or for service maintenance, the person operating the AIB must follow a sequence of steps for permitting the personnel to operate the AIB in a safe manner.

First, the electric motor is stopped, then a brake is actuated by operating a lever that prevents the pumping movement of the AIB. This is necessary because, while the motor movement has been stopped, there are still vertical movements of the pumping head generated by the weight and/or inertia of the movement of the moving parts of the AIB. Finally, for the safety of any operation in the AIB and while the brake has already been actuated, it is necessary to place a safety lock into a locking position. This last step guarantees that the AIB is kept completely immobilized.

Some people without knowledge of the art and without knowledge of the weights and sizes involved in an individual pumping apparatus may find the safety locking operation in the AIB unnecessary. However, this conclusion is absolutely erroneous for individual pumping apparatuses which are big in both volume and mass. This is evident when paying attention to the side counterweights employed in an AIB.

Indeed, because of the complex morphology of the individual pumping apparatuses and since the apparatuses operate under adverse conditions, such as outdoors, to extreme temperatures, sand, dust, wind, snow, etc., the service and maintenance operations are very frequent. In addition, generally these operations are very complex and dangerous for the operators involved in in these operations.

DESCRIPTION OF THE PRIOR ART

Today, an operator follows the above described locking steps to safely guarantee that an individual pumping apparatus is completely stopped and is stable. It happens that in the last step, namely the location of the safety lock into the "locking" position, the operator must literally climb onto the AIB structure. This is because the safety lock is located in a reduction box placed at a height that sometimes exceeds the 2 meters. Practically, the safety lock is safe, However, the operation of the safety lock can be dangerous during adverse weather conditions where the operator must physically touch the safety lock to position the safety lock in the "locking" position. In like manner, but following the inverse procedure, once the maintenance operations have been finished the operator is again exposed to a risky situation when he/she has to place the lock into an "unlocking" position.

It is known that due to the means provided by the prior art, many accidents have occurred to the operators and, sometimes, these accidents have been fatal ones.

The present invention is aimed to solve the inconveniences related to the unsafe situations, including comfort, as occurring in the prior art.

SUMMARY OF THE INVENTION

It is therefore an object of the invention to provide a device for remotely actuating the safety lock of individual oil pumping apparatuses, wherein the device is capable of permitting the operator to actuate the safety lock in a safe manner, thus preventing the operator to enter into contact with the large mechanism of the AIB.

It is still another object of the present invention to provide a device for remotely actuating the safety lock of individual oil pumping apparatuses, wherein the device is capable of permitting the operator to verify the position of the safety lock without the need of entering into contact with the safety lock, with the verification being made through means for indicating the position of the lock.

It is a further object of the present invention to provide a device for remotely actuating the safety lock of individual oil pumping apparatuses, wherein the device is capable of being put into practice in an easy manner without increasing the costs of the individual oil pumping apparatus where the device is installed.

BRIEF DESCRIPTION OF THE DRAWINGS

For better clarity and comprehension of the object of the present invention a preferred embodiment of the same has been illustrated by way of example in the following drawings wherein.

DETAILED DESCRIPTION OF THE INVENTION

Figure 1:
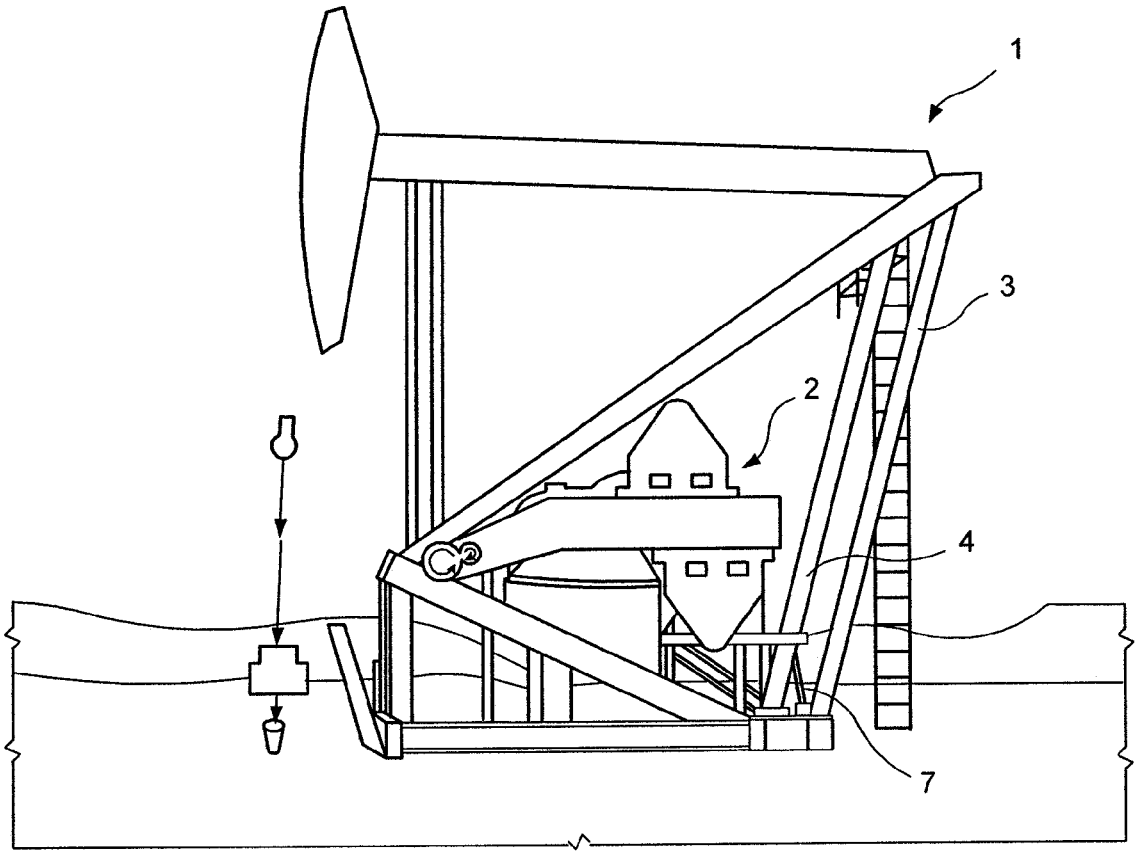
FIG. 1 PRIOR ART
FIG. 1 schematically shows a side elevation view of an individual pumping apparatus or AIB.

First, reference to FIG. 1 will be made where a side elevation schematic view of the individual pumping apparatus is shown and indicated with the general reference number 1. General reference number 2 indicates a locking device (not illustrated in this Figure) as it is known in the prior art. FIG. 1 provides a view of the magnitude of the AIB 1 and it is possible to appreciate the possible lesions that an operator can suffer if he/she is impacted by some of the AIB parts, such as counterweights 3 and 4.

Figure 2:
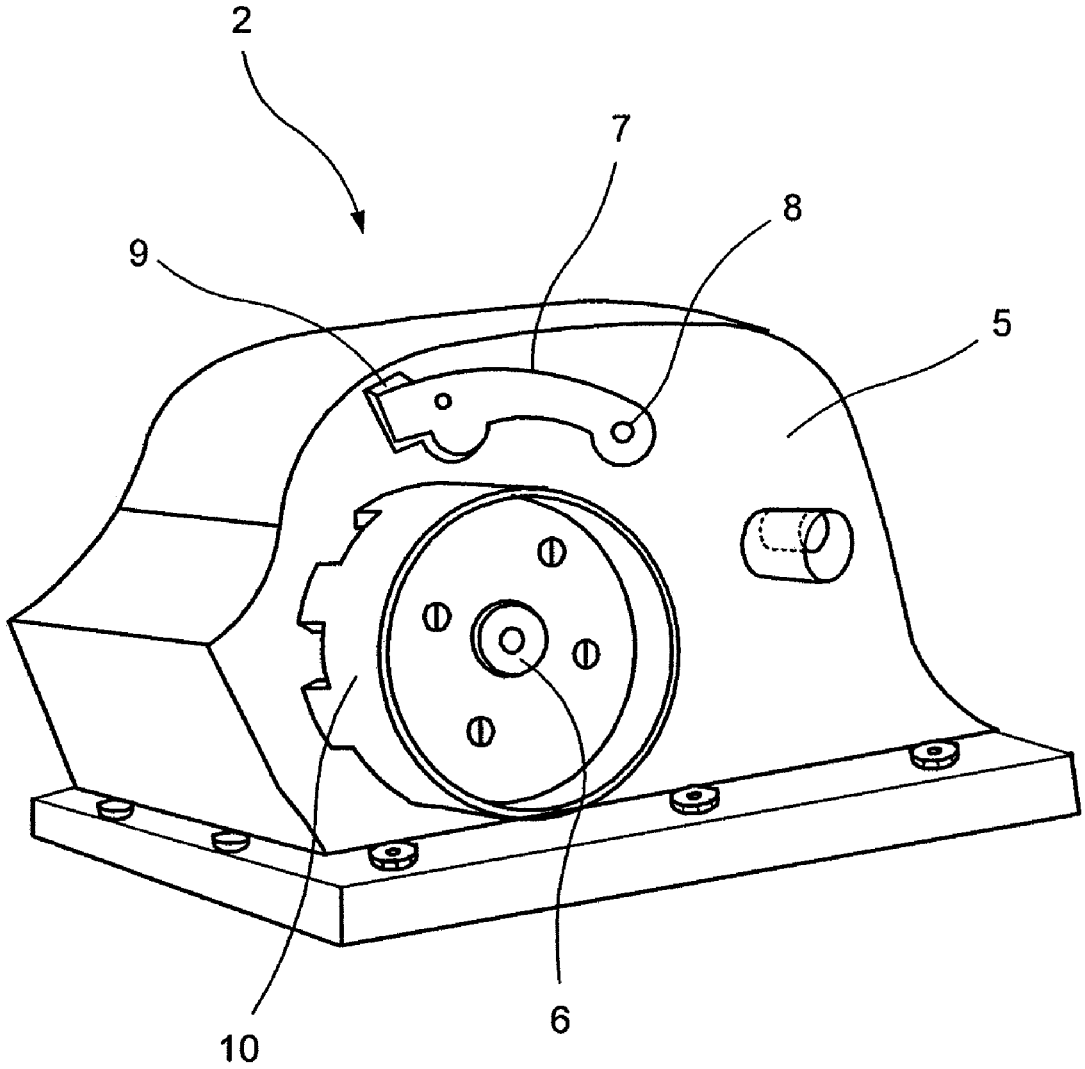
F I G. 2 PRIOR ART
FIG. 2 shows a detail of the parts conforming a locking device according to the prior art.

FIGURE 2 provides an illustration of the parts for a locking device 2 as it is know in the prior art.

As it was explained above, the individual pumping apparatuses are of the type employed in the oil wells for extraction of petroleum and are known as storks, little horses or AIBs. Each AIB includes a motor means which can be an electrical motor, an engine, a pneumatic motor, or the like, which is connected to a reduction box 5. The output of this box is defined by an output shaft 6 operatively connected to a mechanism for general movement of the AIB. The movement of shaft 6, and hence the movement of the moving parts of the AIB, are alternatively restricted by a brake operated by a lever indicated by reference number 7 in FIG. 1. Furthermore, this movement may be locked by locking device 2 (located in the upper middle part of the AIB).

Locking device 2 basically consists of a safety lock 7 including an end 8 rotatably connected to the reduction or gear box and a second end 9 vertically movable and alternatively resting and locking into at least one peripheral groove of a toothed disc 10. The toothed disc 10 is fixedly connected to output shaft 6 of reduction box 5.

When the lock 10 is in a lower position, it is locked into one groove of disc 10, providing a locking position or condition for the AIB. On the other hand, when lock 7 is in an upper position, a unlocking position or condition of the AIB is defined.

The present invention is based in the provision of a remote actuating device for the locking device, or more precisely, a provision of a lifting means for moving upwardly and downwardly safety lock 7. This also permits an operator located in the lower or bottom portion of the AIB to easily actuate said means for moving upwardly and downwardly.

Figure 3:
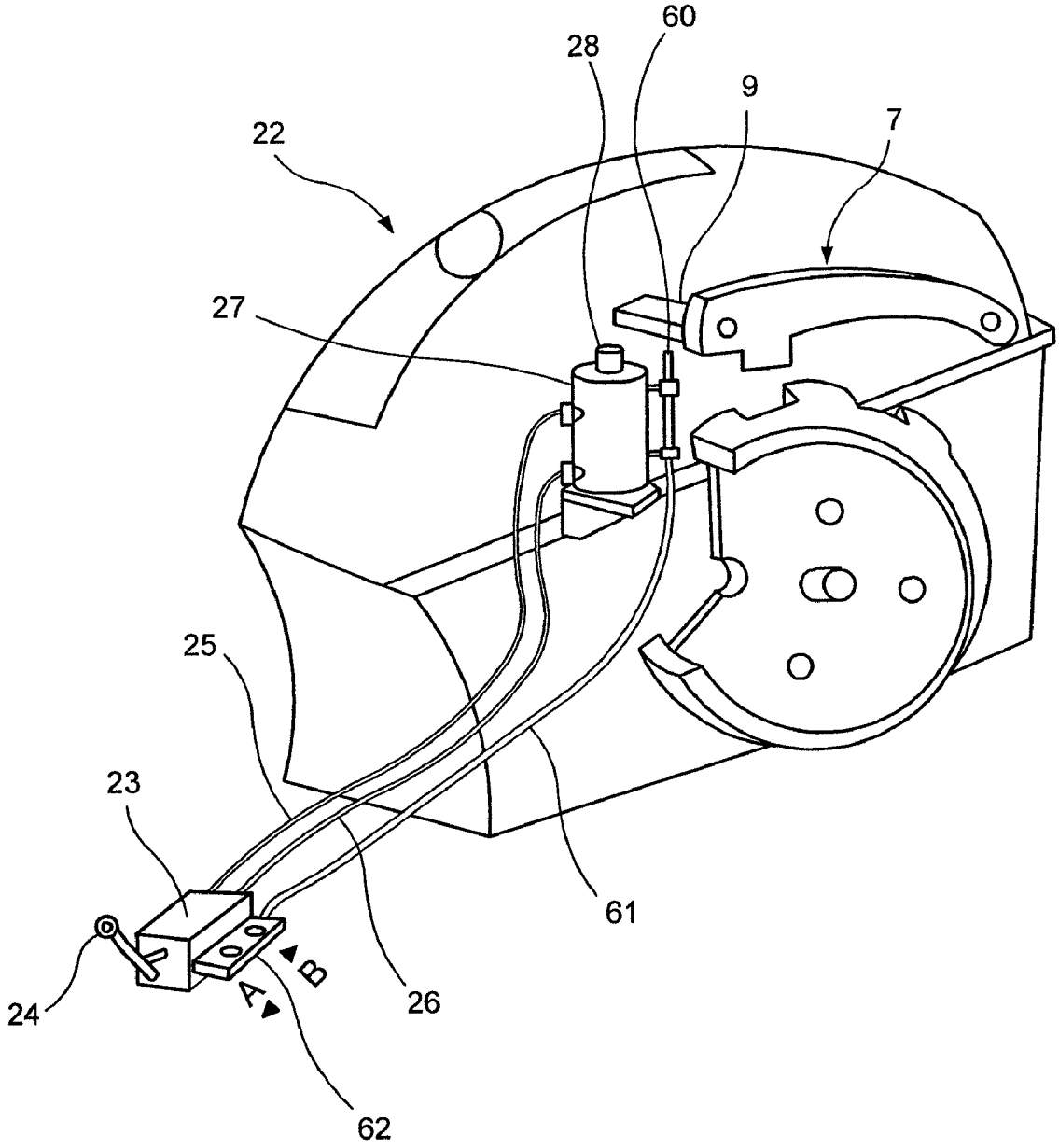
FIG. 3 shows the locking device of FIG. 2 including a remote actuating device according to a first exemplary embodiment (hydraulic) of the present invention.

Now referring to FIG. 3 wherein locking device 22 is shown, it may be seen that the the locking device is very similar to the locking device 2 of FIG. 2, but differing from device 2 in that it includes the device for remote actuation of safety lock 7. This lifting means consists of a hydraulic pump 23 that may be operated or actuated by actuating means 24 arranged in the lower part of the AIB. Pump 23 is connected to a couple of hoses 25 and 26 which, in turn, are connected to a hydraulic cylinder 27. Hydraulic cylinder 27 includes a two-position piston 28 located just below vertically moving end 9 of safety lock 7. In addition, the piston has a longitudinal axis that is substantially coincident with the gravity vector. Specifically, it is normal to the floor where the AIB is installed.

When piston 28 is extended, safety lock 7 will be in an upper position, thereby unlocking the movement of AIB 1. On the other hand, when piston 28 is in its resting position, the safety lock will be in a lower position, thereby locking the movement of the AIB 1

In the exemplary embodiment of FIG. 3, actuating means 24 is a three-position valve for switching the hydraulic circuit defined by pump 23, hoses 25 and 26 and hydraulic cylinder 27. However, the actuating means may be defined by a three-position electric switch for switching the electric circuit (not illustrated) of the hydraulic pump. Additionally, the actuating means may be defined by any other actuator permitting the bi-directionally or actuation of a hydraulic circuit, either directly or indirectly.

F*ig*. 4 shows a second embodiment wherein a locking device 42 is shown, this time remotely actuated by a mechanical arrangement.

In this embodiment, the lifting means for moving upwardly and downwardly safety lock 7 consists of a rotating crank 43 arranged in the lower part of the AIB 1. This crank is mechanically connected to three rods 44, 45 and 46 for transferring the rotation of crank 43. Rods 44, 45 and 46 are connected to each other by crossheads 47 and 48. In addition, rod 46, namely the rod located at a greater distance from rotating crank 43, is mechanically connected to a endless screw 49 which is capable of rotating within a threaded bushing 50. The endless screw 49 is located just below vertically moving end 9 of the safety lock 7. The screw has a longitudinal axis thereof arranged in coincidence to the gravity vector, that is geometrically normal to the floor (like piston 28 of FIG. 3).

The above disclosed arrangement permits the safety lock 7 to be located or placed in the upper position when the screw 49 is extended. It will be placed in the lower position when screw 49 is substantially retracted into the bushing 50.

Figure 4:
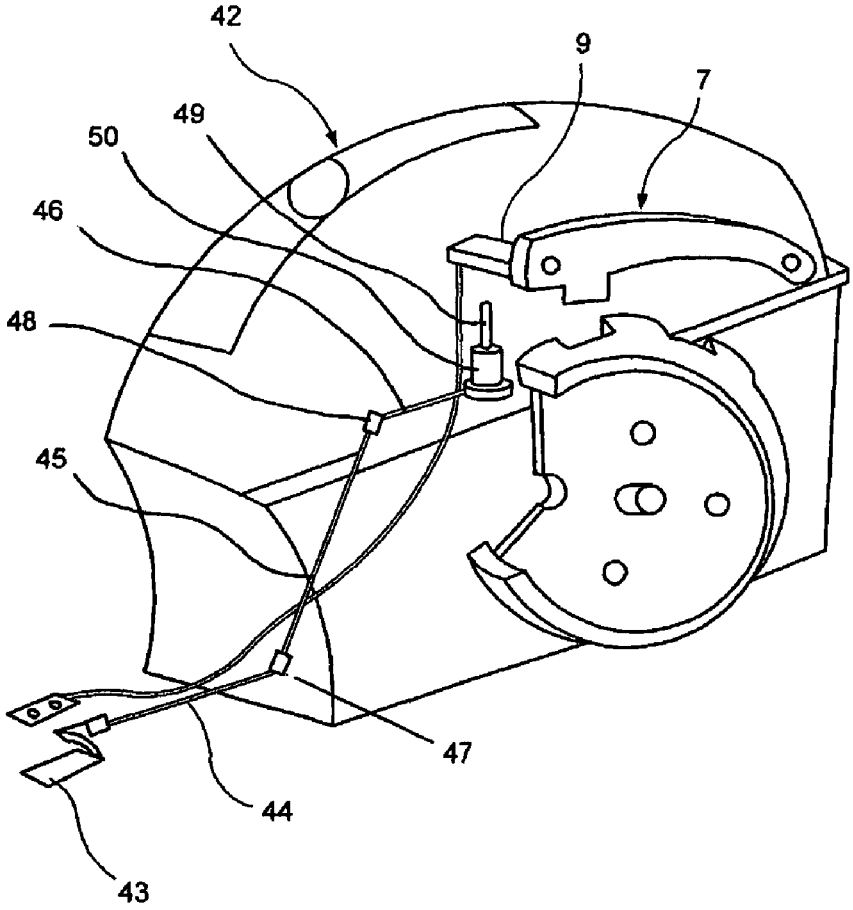
FIG. 4 shows the locking device of FIG. 2 including a remote actuating device according to a second exemplary embodiment (mechanical) of the present invention.

The locking means 22 shown in FIG. 3 as well as its equivalent one shown in FIG. 4 may be an indicator means for indicating the position of safety lock 7. For better clarity and easy disclosure only the description of the operation of this indicator will be made by use of FIG. 3.

As may be appreciated, locking device 22 includes a steel wire 60 movable into a sheath 61 and connected, at a first end thereof, to vertically moving end 9 of safety lock 7. At a second end thereof, a steel wire 60 is connected to the indicator means 62 for indicating the position of safety lock 7. The indicator means 62 is located and arranged in the lower part of the AIB and it is moved by steel wire 60 between a position indicating that safety lock 7 is at its lower position, and a second position indicating that safety lock 7 is in its upper position. The possible movement of indicator means 62 is indicated by arrows A and B.

It is not necessary to remark that the purpose of indicator means 62 is to inform the operator of AIB 1 about the locking condition of the AIB. Therefore, the indicator means 62 is easily viewed by the operator.

In embodiments with minimal variations it is contemplated the possibility that the indicator means 62 may be alternatively anchored in any of the two positions of safety lock 7 that are indicated by the indicator means. This may be achieved, for example, by providing the indicator means with orifices that are coincident with orifices in a plate fixed to the AIB, through which orifices a padlock can be placed, for example, for preventing any movement possibility.

As any person skilled in the art may understand it would be clear that the present patent application aims to disclose the concept of the invention. However, many variations are contemplated in the present invention, such as variations of sizes, materials, number of employed pistons, type of safety lock, cranks, hydraulic valves, use of electric actuators including actuators intelligently controlled by modern electronics, etc. Therefore, all these variants and/or modifications, as well as any other variants and/or modifications that may be naturally put in practice, are included in the concept of the present invention.

The invention claimed is:

1. A device for remotely actuating a safety lock of an individual oil pumping apparatus, the apparatus being of the type for extraction of oil in oil wells and includes a motor, coupled to a gear box having an output shaft operatively connected to a mechanism for moving the apparatus with the movement of the apparatus being alternatively restricted by a brake with the brake being capable of being locked by a locking device arranged in the apparatus, wherein the locking device comprises a safety lock including a first end rotatably connected to the gear box and a second end vertically movable and alternatively resting on and locking into at least one peripheral groove of a toothed disc, the disc being fixedly connected to the output shaft of the gear box, wherein a safety locking position for the apparatus is defined when the said lock is in a lower position, locked in a groove of the disc, and an unlocked position for the apparatus is defined when the lock is in an upper position, and wherein the locking device includes means for moving upwardly and downwardly the safety lock, said means for moving upwardly and downwardly being capable of being actuated by an operator in a lower portion of the apparatus and wherein said means for moving upwardly and downwardly the safety lock comprises a rotating crank arranged in the lower part of the apparatus, the crank being mechanically connected to at least one rotating transferring rod connected to at least one crosshead, the rod being mechanically connected to an endless screw that rotates within a threaded bushing located just below the vertically moving end of the safety lock, the screw and bushing actuating on the safety lock in a manner that the safety lock is placed in the upper position when the screw is extended and it is placed in the lower position when the screw is substantially retracted into the bushing.

2. A device according to claim 1 further comprising a steel wire movable into a sheath and connected, at a first end thereof, to the vertically moving end of the safety lock, and connected, at a second end thereof, to indicator means for indicating the position of the safety lock, said indicator means being arranged in the lower part of the apparatus and moved by the steel wire between a position indicating that the safety lock is at a lower position, and a second position indicating that the safety lock is in an upper position, the indicator means being easily viewed by the operator.

3. A device according to claim 2, wherein said indicator means is alternatively anchored in any of the positions of the safety lock that are indicated by the indicator means.

* * * * *